US007359760B2

(12) United States Patent
Kishi et al.

(10) Patent No.: US 7,359,760 B2
(45) Date of Patent: Apr. 15, 2008

(54) DATA PROCESSING DEVICE AND DATA PROCESSING METHOD

(75) Inventors: Motoshi Kishi, Nagoya (JP); Masaki Shimizu, Toyoake (JP); Noriko Kawabe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/338,742

(22) Filed: Jan. 25, 2006

(65) Prior Publication Data

US 2006/0162634 A1 Jul. 27, 2006

(30) Foreign Application Priority Data

Jan. 27, 2005 (JP) ..... 2005-019852

(51) Int. Cl.
*D05C 5/02* (2006.01)

(52) U.S. Cl. ..... 700/138; 700/136; 112/78; 112/475.19

(58) Field of Classification Search ..... 700/130, 700/131, 132, 133, 136, 138; 112/78, 102.5, 112/475.17, 475.18, 475.19; 101/483
See application file for complete search history.

(56) References Cited

U.S. PATENT DOCUMENTS 5,144,899 A * 9/1992 Allen ..... 112/103
5,499,589 A * 3/1996 Kyuno et al. ..... 112/102.5
5,794,553 A * 8/1998 Futamura ..... 112/102.5
5,927,220 A * 7/1999 Zheng et al. ..... 112/102.5
6,324,441 B1 * 11/2001 Yamada ..... 700/138
6,629,015 B2 * 9/2003 Yamada ..... 700/138
6,952,626 B1 * 10/2005 Taguchi et al. ..... 700/138
6,957,614 B1 * 10/2005 Buck ..... 112/103
2004/0015257 A1 * 1/2004 Bailie ..... 700/138
2004/0154512 A1 * 8/2004 Krasnitz ..... 112/475.18
2004/0221783 A1 * 11/2004 Niimi ..... 112/475.01
2005/0015177 A1 * 1/2005 Hagino et al. ..... 700/132
2005/0178309 A1 * 8/2005 Yamada ..... 112/470.05
2005/0182508 A1 * 8/2005 Niimi et al. ..... 700/138
2007/0022930 A1 * 2/2007 Hagino et al. ..... 112/102.5

FOREIGN PATENT DOCUMENTS

JP A 11-76662 3/1999
WO WO 2004106611 A1 * 12/2004

* cited by examiner

*Primary Examiner*—Gary L. Welch
*Assistant Examiner*—Nathan E Durham
(74) *Attorney, Agent, or Firm*—Oliff & Berridge, PLC

(57) ABSTRACT

A data processing device processes embroidery data for a sewing machine capable of embroidering and print data for a printer that prints a pattern on at least a portion of an embroidery formed by the sewing machine. The data processing device includes an embroidery data generating unit for generating region data defining a plurality of embroidery regions based on color image data and the embroidery data defining embroidery patterns respectively applied to the plurality of embroidery regions, a color designating unit for designating a thread color from a plurality of thread colors contained in the embroidery data in order to designate a print-target embroidery region from among the plurality of embroidery regions, and a print data generating unit that generates print data representing an image applied to the print-target embroidery region based on at least part of image data corresponding to the designated print-target embroidery region.

14 Claims, 18 Drawing Sheets

14

<<PRINT PROCEDURE MENU>>

FIRST GRADATION PROCEDURE(COLOR DESIGNATING PROCEDURE)
SECOND GRADATION PROCEDURE(SEGMENTIZATION PROCEDURE)
THIRD GRADATION PROCEDURE(PATTERN PROCEDURE)

Y

T1

| DENSITY(D) OF AVERAGE COLOR | DENSITY EVALUATING VALUE |
|---|---|
| 5 | (100%) |
| 4 | (80%) |
| 3 | (60%) |
| 2 | (30%) |
| 1 | (0%) |

FIG.19

T2

| DENSITY(D) OF AVERAGE COLOR | FIRST SEGMENTAIZED DATA |
|---|---|
| 5 | 5.0 5.0 4.5 |
| 4 | 4.5 4.0 3.5 |
| 3 | 3.5 3.0 2.5 |
| 2 | 2.5 2.0 1.5 |
| 1 | 1.5 1.0 1.0 |
| | |

FIG.20

DATA PROCESSING DEVICE AND DATA PROCESSING METHOD

CROSS-REFERENCE TO RELATED APPLICATION

This application is related to Japanese Patent Application No. 2005-019852, filed on Jan. 27, 2005. The entire subject matter of the application is incorporated herein by reference.

BACKGROUND

1. Technical Field

Aspects of the invention relates to a data processing device that processes embroidery data used in embroidering machines (including sewing machines capable of embroidering) and print data used in printers.

2. Description of Related Art

Conventionally, embroidering machines are configured to embroider figures on fabric in accordance with embroidery data including information stitch data representing a plurality of needle drop points. Recently, a technique has been developed in which print data (bit map data) is developed based on the embroidery data, and the embroidery pattern can be formed by the printer.

For example, Japanese Patent Provisional Publication No. HEI 11-76662 (hereinafter, referred to as '662 publication) discloses a multi function embroidery system which is configured to form image data based on embroidery data by extracting an outline of an embroidery area based on the embroidery data, and developing a bit map over an area defined by the extracted outline.

In the '662 publication, the embroidery data is configured such that each piece of embroidery data corresponding to embroidery area includes color designating data (thread color data) designating the color of the thread for embroidery at the top of each piece of embroidery data. By associating a color designation code with corresponding image data, it becomes possible to display and print images of the embroidery regions (i.e., images within the outlines) in colors respectively corresponding to the color designation codes of the embroidery regions.

There is a demand for making fabric (e.g., a T-shirt) having a particular texture by harmonizing goodness of printing with goodness of embroidering. However, the technique disclosed in '662 publication can not be used to harmonize goodness of printing with goodness of embroidering. The reason is that, in the device disclosed in '662 publication, only outlines of embroidery regions are obtained from embroidery data and each area surrounded by each outline (each embroidery region) is filled with a color corresponding to a color designation code assigned to each embroidery region. That is, within an embroidery region, a boundary between the printed portion and embroidered portion is indefinite, and the printing is performed for the entire region.

Thus, according to such a technique, printing ink is unnecessarily consumed, and further, a desired 3-dimension feel or texture by harmonizing the embroider and printed image cannot be expressed.

SUMMARY OF THE INVENTION

Aspects of the invention are advantageous in that an improved data processing device is provided to generate print data realizing the desired 3-D feel or texture on the fabric based on the embroidery data.

BRIEF DESCRIPTION OF THE ACCOMPANYING DRAWINGS

FIG. 1 schematically shows a configuration of an embroidering and printing system according to aspects of the invention.

FIG. 19 shows an exemplary data structure of an average color density table.

FIG. 20 shows an exemplary data structure of a segmentized process table.

DETAILED DESCRIPTION

General Overview

Figure 1:
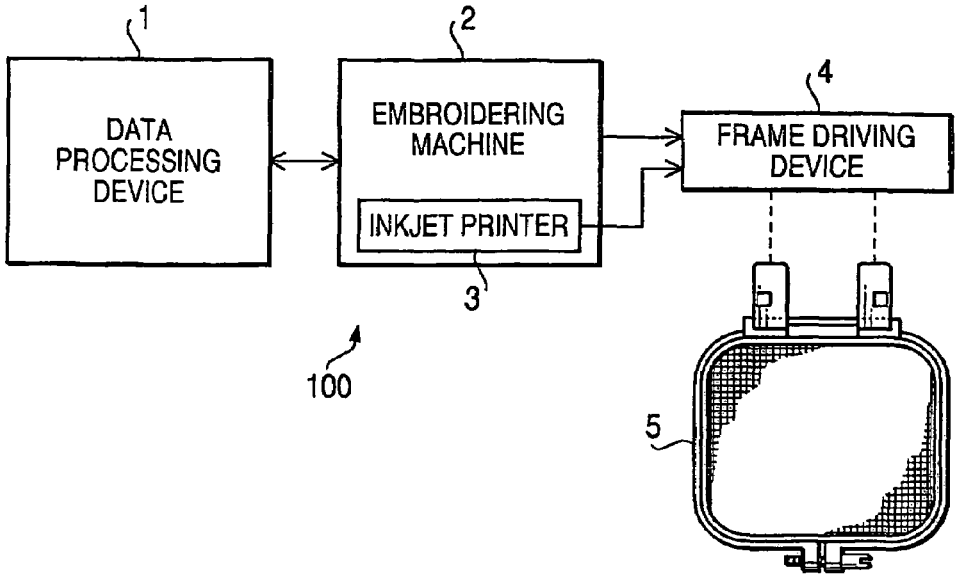

It is noted that various connections are set forth between elements in the following description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

Aspects of the invention provide a data processing device configured to process embroidery data for a sewing machine capable of embroidering and print data for a printer, the printer printing a pattern on at least a portion of an embroidery formed by the sewing machine. The data processing device includes an embroidery data generating unit configured to generate region data defining a plurality of embroidery regions based on color image data and the embroidery data defining embroidery patterns to be formed on the plurality of embroidery regions, respectively, a color designating unit configured to designate a thread color from a plurality of thread colors contained in the embroidery data in order to designate a print-target embroidery region from among the plurality of embroidery regions, and a print data generating unit that generates print data representing an image formed on the print-target embroidery region based on at least part of image data corresponding to the print-target embroidery region designated by the color designating unit.

The print data generating unit may include a color compensation unit that compensates for the print data such that the thickness density of a color of the pattern printed based on the print data on the print-target embroidery region is reduced corresponding to the color of the thread forming the embroidery at the embroidery region.

According to aspects of the invention, there is also provided a data processing device configured to process embroidery data for a sewing machine capable of embroidering and print data for a printer, the printer printing a pattern on at least a portion of an embroidery formed by the sewing machine. The data processing device includes a region data generating unit configured to generate region data defining a plurality of embroidery regions having different thread colors based on the embroidery data, an average color data generating unit configured to divide the embroidery region of a similar color into a plurality of meshes in accordance with the embroidery data and the region data, and create average color data representing average of the thread colors of each mesh area, a segmentized data generating unit configured to generate segmentized area data and segmentized area color data by segmentizing each mesh area so that the color gradually changes between two adjacent mesh areas of the similar color in accordance with the region data and the average color data, and a print data generating unit that generates print data representing a print pattern to be applied to the embroidery region based on the segmentized area data and segmentized area color data generated by the segmentized data generating unit.

The similar color may include a thick color and a thin color.

According to aspects of the invention, there is provided a data processing device configured to process embroidery data for a sewing machine capable of embroidering and print data for a printer, the printer printing a pattern on at least a portion of an embroidery formed by the sewing machine. The data processing device includes a pattern storage unit configured to store a plurality of image patterns for printing, a pattern designating unit configured to designate a desired image pattern from among the plurality of image patterns stored in the pattern storage unit, a region data generating unit configured to generate region data defining a plurality of embroidery regions based on the embroidery data, a region designating unit configured to designate a desired embroidery region among the plurality of embroidery regions, and a print data generating unit configured to generate print data which applies the image pattern designated by the pattern designating unit to the embroidery region designated by the region designating unit in accordance with the region data of the plurality of embroidery regions defined by the region data generating unit.

The pattern storage unit may store a plurality of predetermined gradation patterns, and the print data generating unit may generate the print data which applies the gradation pattern designated by the pattern designating unit to the embroidery region designated by the region designating unit.

Each of the plurality of predetermined gradation patterns stored in the pattern storage unit may be defined by monochromatic gradation pattern data and color designating data.

According to aspects of the invention, there is provided a computer program product comprising computer readable instructions that cause a computer to execute a method of processing embroidery data for a sewing machine capable of embroidering and print data for a printer, the printer printing a pattern on at least a portion of an embroidery formed by the sewing machine. The method comprising the steps of generating region data defining a plurality of embroidery regions based on color image data and the embroidery data defining embroidery patterns to be formed on the plurality of embroidery regions, respectively, designating a thread color from a plurality of thread colors contained in the embroidery data in order to designate a print-target embroidery region from among the plurality of embroidery regions, and generating print data representing an image formed on the print-target embroidery region based on at least part of image data corresponding to the print-target embroidery region designated in the color designating step.

The step of generating print data may include a step of compensating for the print data such that the thickness density of a color of the pattern printed based on the print data on the print-target embroidery region is reduced corresponding to the color of the thread forming the embroidery at the embroidery region.

According to aspects of the invention, there is provided a computer program product comprising computer readable instructions that cause a computer to execute a method of processing embroidery data for a sewing machine capable of embroidering and print data for a printer, the printer printing a pattern on at least a portion of an embroidery formed by the sewing machine. The method comprising the steps of generating region data defining a plurality of embroidery regions having different thread colors based on the embroidery data, dividing the embroidery region of a similar color into a plurality of meshes in accordance with the embroidery data and the region data, and creating average color data representing average of the thread colors of each mesh area, generating segmentized area data and segmentized area color data by segmentizing each mesh area so that the color gradually changes between two adjacent mesh areas of the similar color in accordance with the region data and the average color data, and generating print data representing a print pattern to be applied to the embroidery region based on the segmentized area data and segmentized area color data.

The similar color may include a thick color and a thin color.

According to aspects of the invention, there is provided a computer program product comprising computer readable instructions that cause a computer to execute a method of processing embroidery data for sewing machine capable of embroidering and print data for a printer, the printer printing a pattern on at least a portion of an embroidery formed by the sewing machine. The method comprising the steps of storing a plurality of image patterns in a pattern storage unit for printing, first designating a desired image pattern from among the plurality of image patterns stored in the pattern storage unit, generating region data defining a plurality of embroidery regions based on the embroidery data, second designating a desired embroidery region among the plurality of embroidery regions, and generating print data which applies the image pattern designated in the first designating to the embroidery region designated in the second designating in accordance with the region data of the plurality of embroidery regions defined in the step of generating.

The pattern storage unit may store a plurality of predetermined gradation patterns, and the step of generating print data may generate the print data which applies the gradation pattern designated by the pattern designating unit to the embroidery region designated by the second designating step.

Each of the plurality of predetermined gradation patterns stored in the pattern storage unit may be defined by monochromatic gradation pattern data and color designating data.

Embodiment

Hereinafter, referring to the accompanying drawings, a data processing device according to an illustrative embodiment of the invention will be described.

FIG. 1 schematically shows a configuration of an embroidering and printing system 100 including an embroidery data processing device 1, an embroidering machine 2 and a frame driving device 4. In the system 100, the embroidery data processing device 1 is electrically connected to the embroidering machine 2 having an inkjet printer 3, and the frame driving device 4 is connected to the embroidering machine 2. One of various types of embroidery frames 5 can be detachably attached to the frame driving device 4.

The frame driving device 4 is configured to move the embroidery frame 5, in two directions intersecting at right angles, for an embroidery operation to be executed by the embroidering machine 2 and a printing operation to be executed by the inkjet printer 3.

Figure 2:
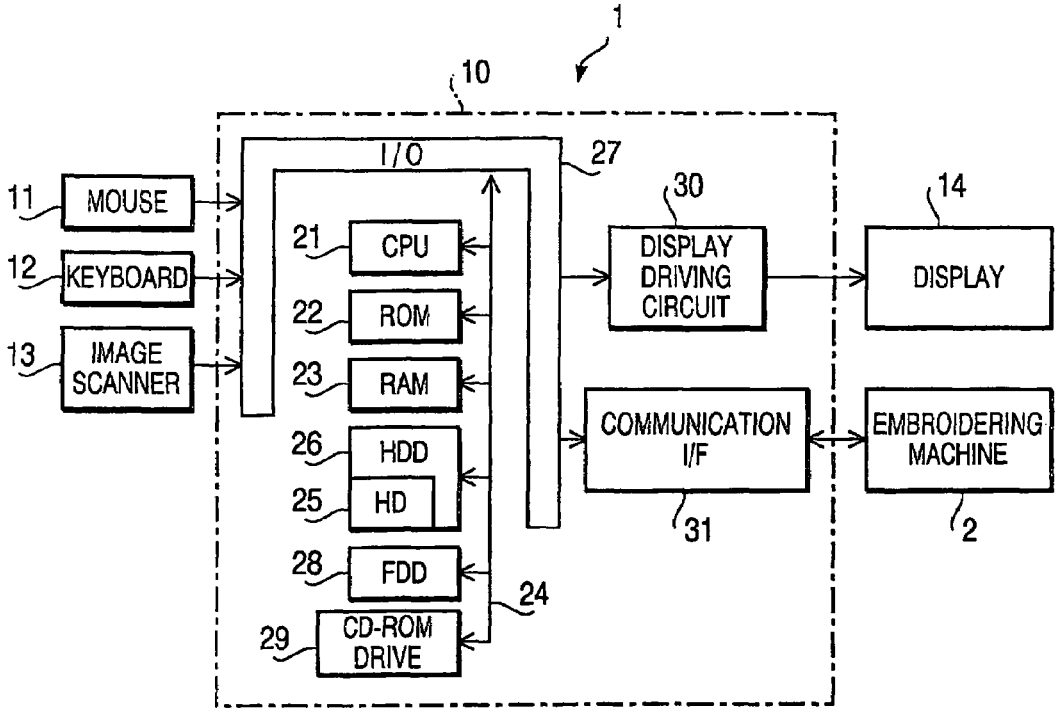
FIG. 2 is a block diagram of an embroidery data processing device provided in the embroidering and printing system shown in FIG. 1.

FIG. 2 is a block diagram of the embroidery data processing device 1 which is constituted by a personal computer. As shown in FIG. 2, the embroidery data processing device 1 includes a control unit 10, a mouse 11 connected to the control unit 10, a keyboard 12, an image scanner 13 and a display 14. The control unit 10 includes a microcomputer having a CPU (central processing unit) 21, a ROM 22, and a RAM 23, which are connected to each other via a bus 24. The control unit 10 further includes a hard disk drive (HDD) 26 having a hard disk (HD) 25 and an input/output (I/O) interface 27.

A flexible disk drive (FDD) 28 and a CD-ROM drive 29 are also connected to the bus 24. The mouse 11, the keyboard 12, the image scanner 13, a display driving circuit 30 for driving the display 14, and a communication interface 31 interfacing the control unit 10 with the embroidering machine 2 are connected to the I/O interface 27.

In the ROM 22, various types of programs, such as a start up program for starting up the personal computer (the embroidery data processing device 1), are stored. In the RAM 23, an image data memory area for storing image data of printing patterns read by the image scanner 13 or read from a flexible disk or a CD-ROM, an embroidery data memory area for storing embroidery data of embroidery patterns, areas for storing results of calculating operations of the CPU 21, buffer areas, pointer areas, counter areas, and the like are allocated, and these areas are used on an as needed basis.

In the hard disk 25, an operating system, drivers for the mouse 11, keyboard 12, the image scanner 13 and the display 14, application programs and the like are stored. A control program for obtaining image data or embroidery data from the image scanner 13, the flexible disk, or the CD-ROM, a data input/output control program for storing the image data or the embroidery data in the image data memory area or the embroidery data memory area, a control program for embroidery data processing are also stored in the HDD 26 (see FIG. 4). Print data or embroidery data may be stored in the HDD 26.

Figure 3:
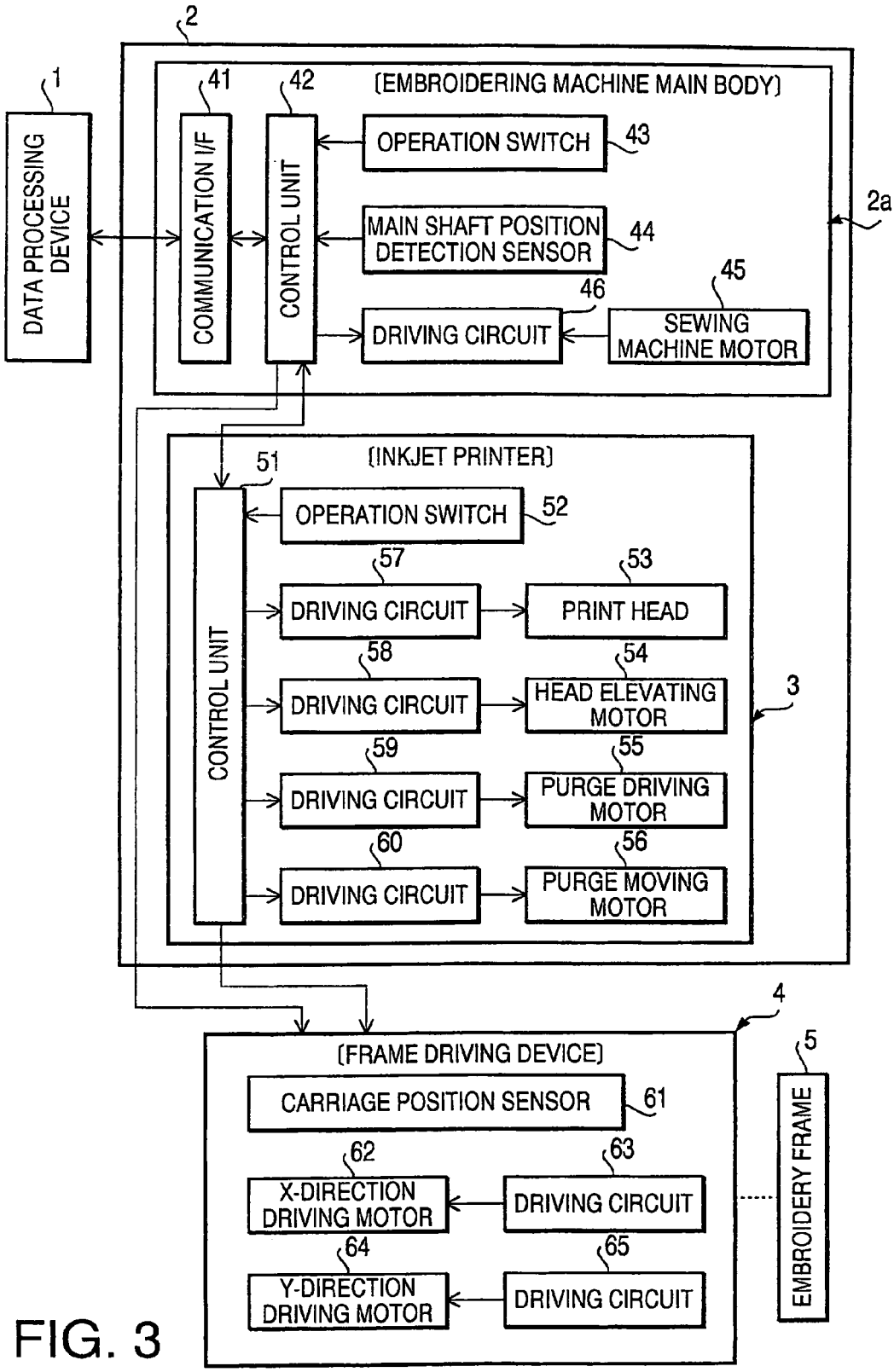
FIG. 3 shows a block diagram of an embroidering machine provided in the embroidering and printing system shown in FIG. 1.

As shown in FIG. 3, the embroidering machine 2 includes a main body 2*a*. The main body 2*a* includes a communication interface (I/F) 41, a control unit 42, a switch unit 43 having various types of switches, a main shaft position sensor 44, a sewing machine motor 45 and a driving circuit 46 for the sewing machine motor 45. The control unit 42 is connected to the embroidery data processing device 1 via the communication I/F 41. By rotations of the sewing machine motor 45, a main shaft (not shown) is rotated. The rotations of the main shaft cause a needle bar up-and-down driving mechanism (not shown) to move a needle bar up and down. By cooperation of the up and down movement of a sewing needle of the needle bar and a thread taker mechanism (not shown) provided in a bed portion, embroidery stitches are formed on fabric W held by the embroidery frame 5.

The inkjet printer 3 includes a control unit 51, a switch unit 52 having various types of switches, a print head 53 in which nozzles for four colors (cyan, magenta, yellow and black) are arranged in four rows, a head elevating motor 54, a purge driving motor 55, a purge moving motor 56, driving circuits 57, 58, 59 and 60 provided for the print head 53, the head elevating motor 54, the purge driving motor 55 and the purge moving motor 56, respectively. When the print head 53 receives a print command from the control unit 51, the print head 53 operates to eject ink downwardly to the fabric W through use of deformation of a piezoelectric ceramic actuator.

The frame driving device 4 includes a carriage position sensor 61, an x-direction driving motor 62 for moving the embroidery frame 5 in an x-direction, a y-direction driving motor 64 for moving the embroidery frame 5 in a y-direction, driving circuits 63 and 65 provided for the x-direction driving motor 62 and the y-direction driving motor 64, respectively. When the frame driving device 4 receives a frame movement command signal from the control unit 42 of the main body 2*a* of the embroidering machine 2 or the control unit 51 of the inkjet printer 3, the frame driving device 4 drives the x-direction motor 62 and the y-direction motor 64 to move the embroidery frame 5 in the x and y directions.

Figure 4:
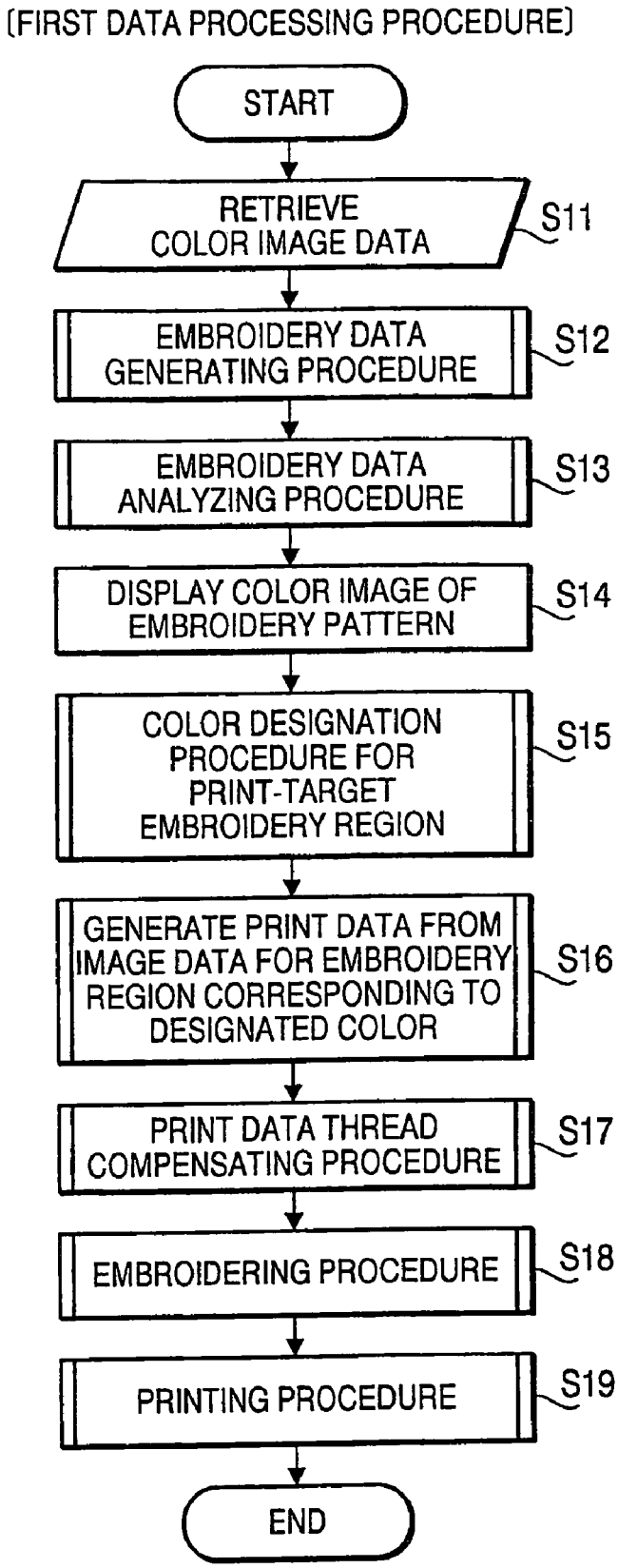
FIG. 4 is a flowchart illustrating a procedure of a first data processing according to aspects of the invention.

Hereafter, procedures for embroidery data to be executed by the control unit 10 of the embroidery data processing device 1 will be described with reference to flowchart of FIG. 4. In the following description, "Si" (i=11, 12, 13, . . . ) represents each step number.

When the user set an original sheet Y on which a color image is drawn to the image scanner 13, and selects "data processing" in a main menu displayed on the display 14, a "data processing menu" (an example being shown in FIG. 6) is displayed on the display 14. When the user selects a "first gradation processing" in the menu using a pointer or cursor, a procedure of a first data processing shown in FIG. 4 is executed.

When this procedure is started, the control reads the color image of the original sheet Y set to the image scanner 13 to generate image data (S11). Then, the control executes an embroidery data generating procedure for generating the embroidery data by executing an embroidery data generating control program based in the image data (S12). Next, based on the embroidery data, an embroidery data analyzing procedure is executed to obtain embroidery regions designated by stitch types (e.g., satin stitch, tatami stitch, etc.) and/or thread colors (S13).

Specifically, all the needle drop points (n points) included in the embroidery data are represented by Pi (i=1, 2, . . . , n) in the order of sewing. An orthogonal coordinate system is defined with variable i being set to "1", and the needle drop pint Pi being defined as an origin of the coordinate system.

Figure 5A:
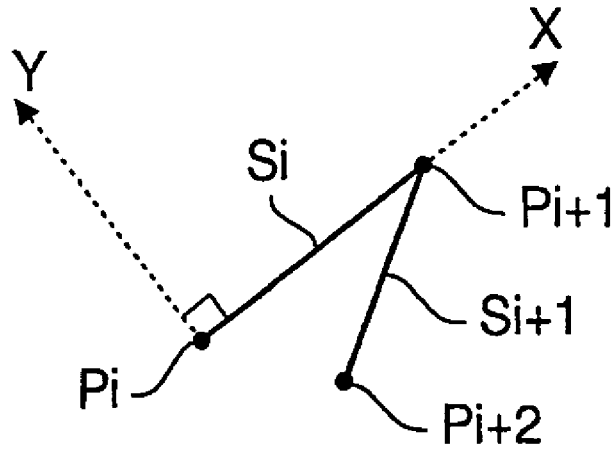
FIG. 5A illustrates an example of a stitch pattern having turning back of stitches.
Figure 5B:
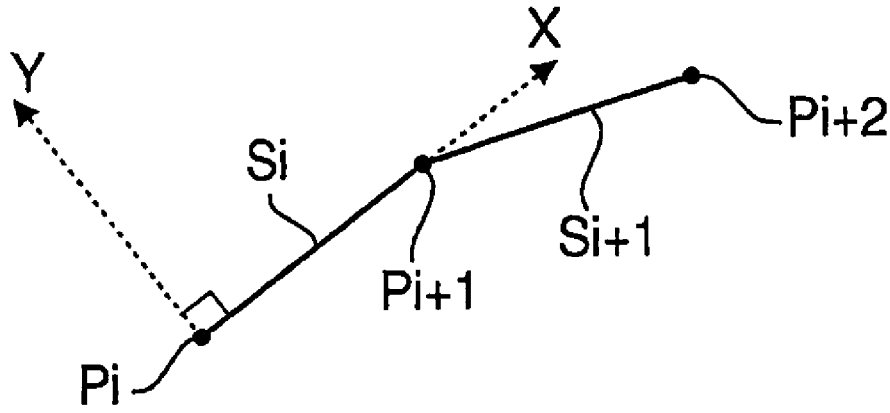
FIG. 5B illustrates an example of a stitch pattern not having turning back of stitches.

As shown in FIGS. 5A and 5B, the X-axis is defined along a line extending from a needle drop point (the origin point) Pi to a needle drop point $P_{i+1}$, and Y-axis is set along a line obtained by rotating counterclockwise the X-axis by 90°. Then, a coordinate ($X_{i+1}$, 0) of the needle drop point $P_{i+1}$ and the coordinate ($X_{i+2}$, $Y_{i+2}$) of the needle drop point $P_{i+2}$ are read out from the embroidery data, and are stored in a coordinate memory area in the RAM 23.

Next, the values of $X_{i+1}$ and $X_{i+2}$ are compared with each other. If $X_{i+1}$ is greater than $X_{i+2}$, the attribute of the needle drop point $P_{i+1}$ is defined as a tentative contour point. If $X_{i+2}$ is greater than or equal to $X_{i+1}$ ($X_{i+2} \geqq X_{i+1}$), the attribute of the needle drop point $P_{i+1}$ is defined as a tentative running stitch point. If the needle drop point $P_{i+1}$ is a contour point as shown in FIG. 5A, turning back is caused in regard to the stitches $S_i$ and $S_{i+1}$. In this case, $X_{i+2}$ is smaller than $X_{i+1}$ ($X_{i+2} < X_{i+1}$). In this case, the attribute of the needle drop point $P_{i+1}$ can be assumed to be a contour point, and therefore the needle drop point $P_{i+1}$ is defined as a tentative contour point.

If the needle drop point $P_{i+1}$ is a running stitch point, $X_{i+2}$ is greater than or equal to $X_{i+1}$ ($X_{i+2} \geqq X_{i+1}$) as shown in FIG. 5B. In this case, the needle drop point $P_{i+1}$ can be assumed to be a running stitch point and therefore the attribute of the needle drop point $P_{i+1}$ is defined as a tentative running stitch point. Attributes of tentative running stitch points are assigned to needle drop points $P_1$ and Pn.

The above mentioned process is executed repeatedly while the variable i is incremented. In the state where (i+1) reaches n, all of the needle drop points (i+1=2 to n−1) have been assigned attributes of tentative contour points or tentative running stitch points.

Next, the stitch forms are categorized as follows. First, the control unit 10 judges whether a needle drop point $P_{i+1}$ is assigned the attribute of the tentative contour point while assigning 1, 2, 3 . . . to the variable i. If $P_{i+1}$ is a tentative running stitch point, the control unit 10 assigns a next greater value to the variable i and repeats the above judgment. If $P_{i+1}$ is the tentative contour point, the control unit 10 judges whether the needle drop point $P_{i+1}$ adjoins to a needle drop point having the attribute of the tentative running stitch point (i.e., judges whether one of the needle drop points $P_i$ and $P_{i+2}$ is the tentative running stitch point). If the point $P_{i+1}$ adjoins to a point having the attribute of the tentative running stitch point, $Y_{i+2}$, which has been saved in the process in which the tentative contour point attribute is assigned to the needle drop point $P_{i+1}$, is read out.

If signs of $Y_{i+2}$ obtained in a like manner for the needle drop points of the tentative contour point located on the front or rear side of the point $P_i$ are different from each other, a tentative tatami contour is assigned to the stitch attribute of the needle drop point $P_{i+1}$. If signs of $Y_{i+2}$ obtained in a like manner for the needle drop points of the tentative contour point located on the front or rear side of the point $P_i$ are equal to each other, a tentative running stitch is assigned to the stitch attribute of the needle drop point $P_{i+1}$.

If the needle drop point $P_{i+1}$ of tentative contour points does not adjoin to a needle drop point of the tentative running stitch point and signs of $Y_{i+2}$ between the front and rear tentative contour points are replaced with each other, the needle drop point $P_{i+1}$ is assigned a tentative satin contour. On the other hand, signs of $Y_{i+2}$ between the front and rear tentative contour points are not replaced with each other, an attribute of a tentative running stitch point is assigned to the needle drop point $P_{i+1}$.

Finally, shapes, thread densities, tatami patterns, and etc. of needle drop points located at the front and rear sides of each of the needle drop points assigned the attribute of the tentative tatami contour are obtained, and a process for fixing a contour of an embroidery region of the tatami stitch is executed using the obtained data. Shapes, thread densities, and etc. of needle drop points located at the front and rear sides of each of the needle drop points assigned the attribute of the tentative satin contour are obtained, and a process for fixing a contour of an embroidery region of the satin stitch is executed using the obtained data. Then, a process for fixing the needle drop points, which are not defined as the tentative tatami contour attribute and the tentative satin contour attribute, as an embroidery region of the running stitch is executed.

Next, based on the analysis result, the embroidery region of the embroidery pattern is displayed with the representation of stitching patterns on the display 14 as a color image (S14). Using the color image displayed on the display 14, a color designating procedure allowing the user to designate the thread color of the embroidery region subject to printing using the pointer is executed (S15).

Next, a print data generating procedure is executed (S16). In the print data generating procedure, among a plurality of embroidery regions obtained in the analyzing procedure, for an embroidery region designated by the thread color, print data for executing a printing on a print target embroidery region is generated based on the image data corresponding to the designated region. Next, to the print data generated as above, a color compensation procedure is applied (S17) so that the color density of the printed image is reduced in accordance with the color of the thread forming the embroidery pattern on the target print region.

Then, based on the embroidery data generated in S12, the embroidery procedure is executed by the embroidering machine 2 (S18). Further, based on the print data as compensated in S17, the printing procedure is executed by the inkjet printer 3 (S19). Then, the control finishes the procedure.

The first data processing will be further described.

Figures 6, 7:
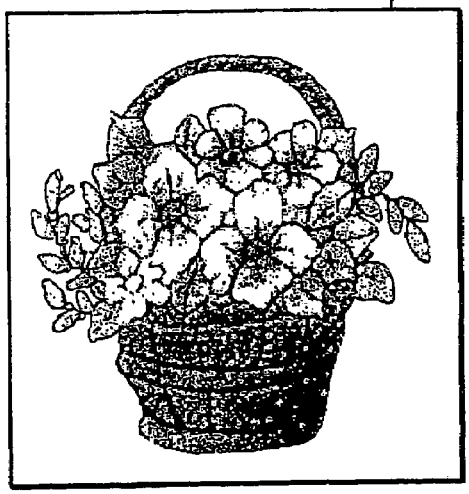
FIG. 6 shows an example of a print processing menu.
FIG. 7 is a plan view of a sheet on which a color image is drawn.

When the user sets the original sheet Y on which the "flower basket" is drawn to the image scanner 13, as show in FIG. 7, and selects, using the pointer, the "first gradation processing" at the top of the "data process menu" shown in FIG. 6, the color image of the "flower basket" is read and the color image data is generated. Then, based on the color image data, the embroidery data is generated.

Figure 8:
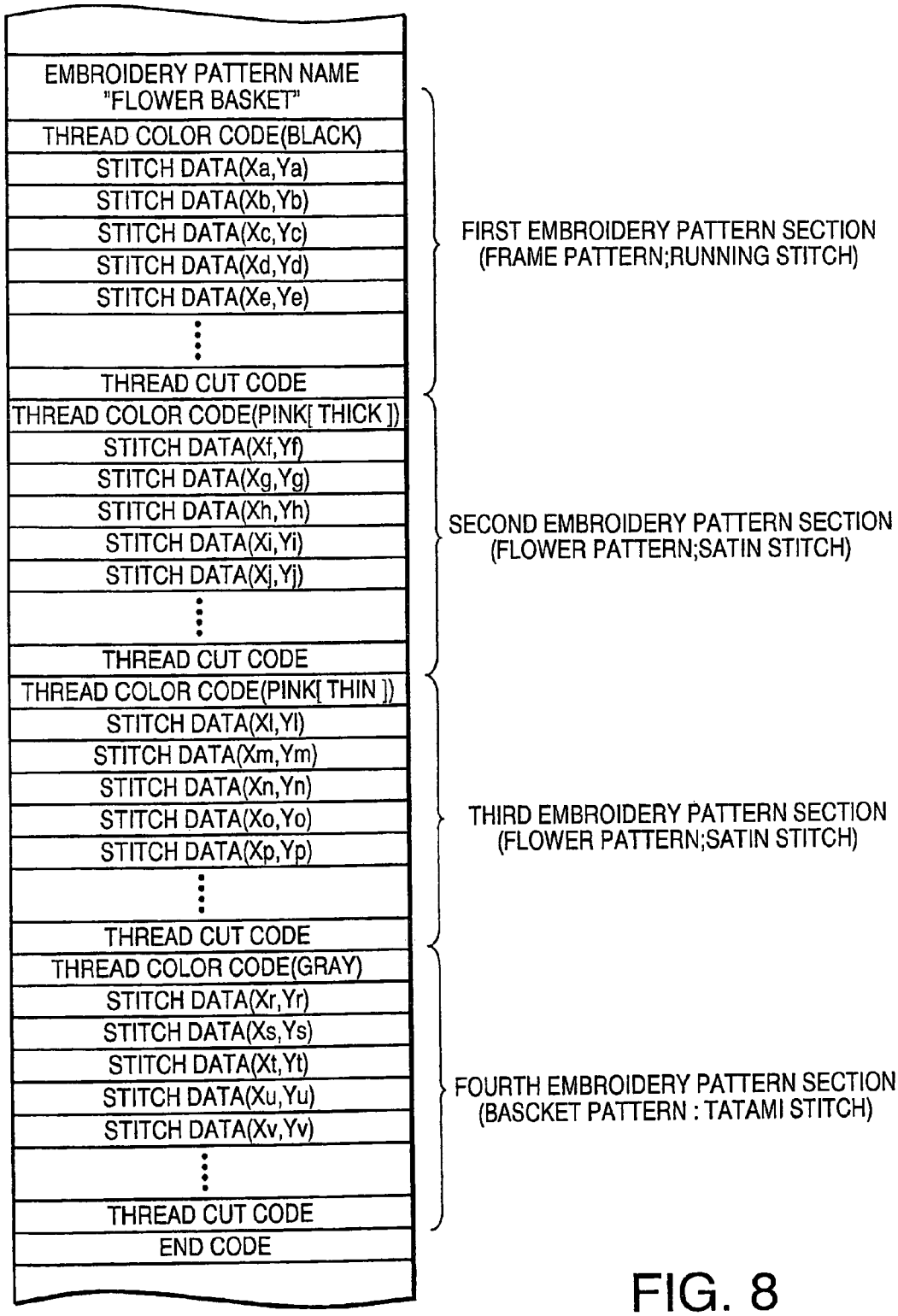
FIG. 8 shows an exemplary data structure of embroidery data of an embroidery pattern "flower basket".

In the embroidery data generating procedure, from the color image data, region data defining a plurality of embroidery regions is generated, and further, the embroidery data for embroidering each of the plurality of embroidery regions is generated. The embroidery data is configured to include, as shown in FIG. 8, for each of contour patters, flower patterns, and the pattern of the basket, sewing data representing the thread color codes and needle drop points (feed amount). The embroidery data contains data for a plurality of embroidery regions, each contains a plurality of sewing data delimited with thread cut codes. It should be noted, however, as the thread color of the flower pattern formed with the satin stitches, colors similar to pink (e.g., thick pink, thin pink, etc.), colors similar to orange (e.g., thick orange, think orange, etc.) are stored.

Figure 9:
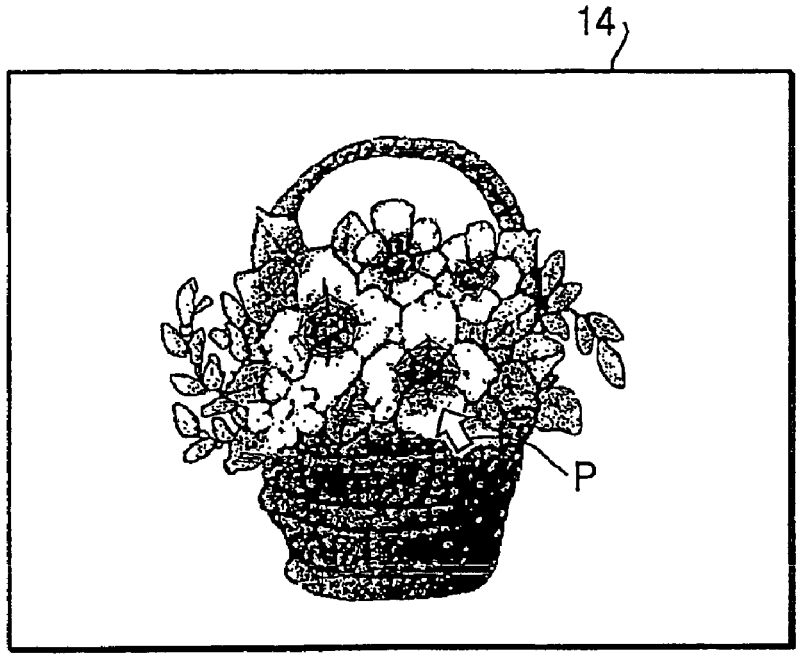
FIG. 9 shows an example of onscreen representation of an embroidery region of the flower basket according to aspects of the invention.
Figure 10:
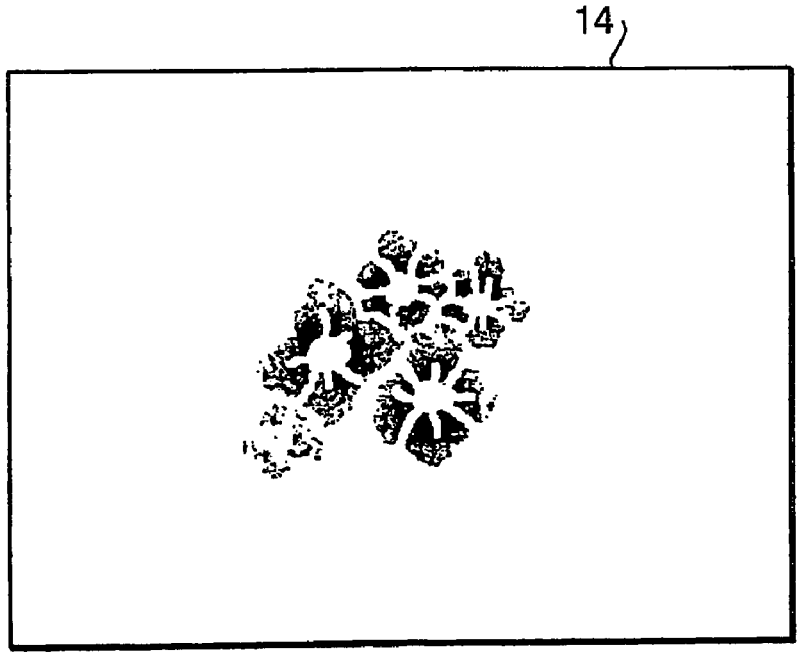
FIG. 10 shows an example of onscreen representation of pink embroidery region of the flower basket according to aspects of the invention.

Next, the embroidery region of the embroidery pattern is displayed as a color image as shown in FIG. 9. If the user designate the "pink" of the flower pattern using the pointer P, the embroidery area corresponding to the pink is designated. Then, as shown in FIG. 10, the embroidery region whose color is pink is extracted and displayed selectively on the display 14. At this stage, from portion of the image data for the pink embroidery region, the print data is generated.

Figure 11:
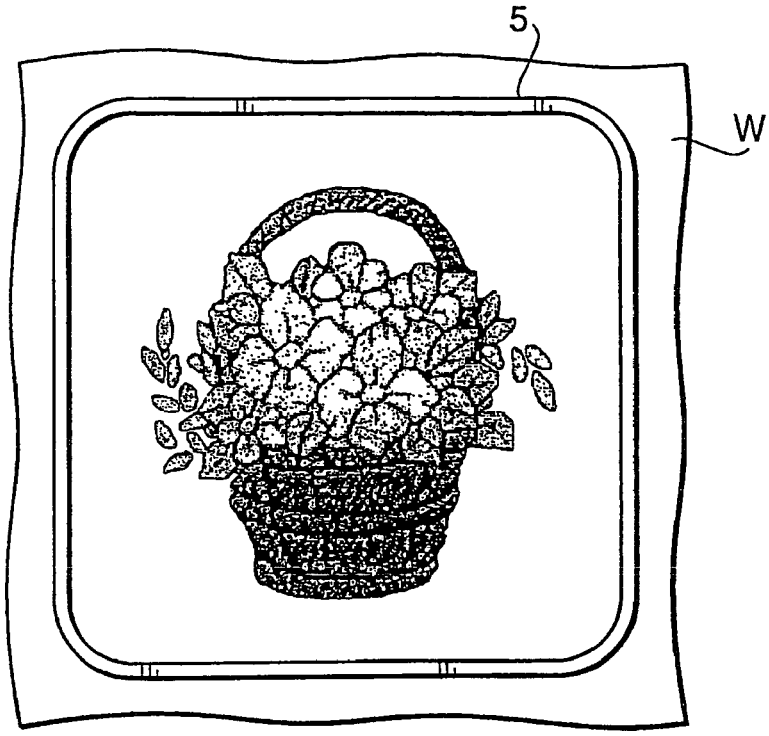
FIG. 11 shows an example of an embroidery pattern, "flower basket" formed on fabric according to aspects of the invention.

After the embroidery data and the print data are generated, in the embroidery procedure instructed by the user, the flower basket is embroidered on the fabric W set to the embroidery frame 5 as shown in FIG. 11. At this stage, based on the embroidery data shown in FIG. 8, only the embroidering is executed. Regarding the flower pattern, using a relatively small numbers of threads (including thick pink thread, thin pink thread, etc.), only the embroidering has been done, the expression of "flower petal" may be insufficient in terms of its reality, texture, and the like.

Next, in accordance with the printing procedure instructed by the user, the flower pattern is printed (overlaid) on the embroidered pattern on the fabric W set to the embroidery frame 5. Since the print data retains the colors of the original image, the flower pattern including a plurality of colors are used in the printed flower pattern, which has a colorful appearance. Since the reality and texture of the "flower petal" pattern is well improved, the entire image of the "flower basket" has an improved appearance.

In the color designating procedure, only one color is designated to generate the print data in the illustrative embodiment. The invention need not be limited to such a configuration, and it can be modified such that designation of a plurality of colors or all the colors is enabled, and the print data may be generated for plurality of designated color regions.

Figure 13:
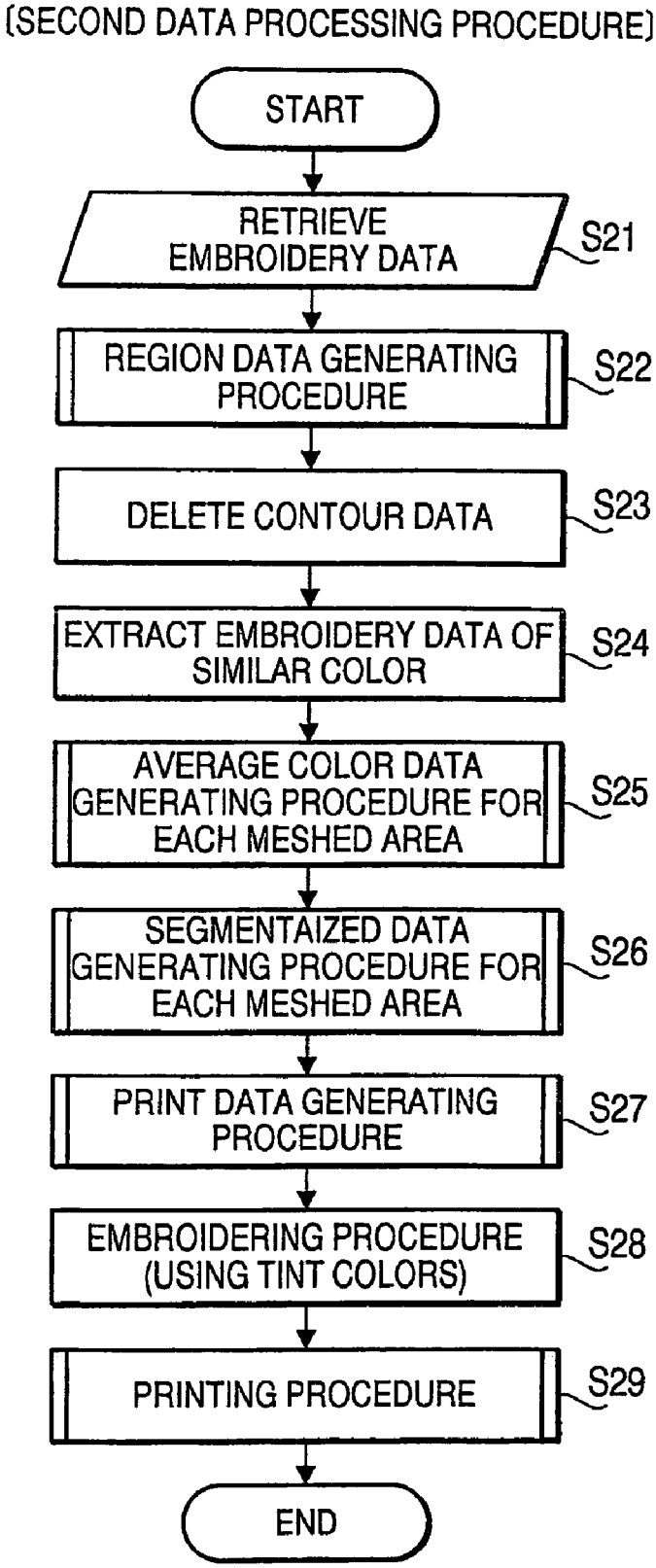
FIG. 13 shows a flowchart illustrating a procedure of a second data processing according to aspects of the invention.

Next, when the user selects, from the "data processing menu" shown in FIG. 6, a "second gradation processing" using the pointer P, the second data processing show in FIG. 13 is started. When this procedure is started, a predetermined embroidery data is retrieved from a plurality of pieces of the embroidery data stored in the CD-ROM or RAM (S21). Then, a region data generating procedure (analysis of the embroidery data) is executed (S22) to define a plurality of embroidery regions.

The region data generating procedure is similar to that described above with reference to FIGS. 5A and 5B, and thus the description is omitted for the brevity. Next, based on the analysis by the region data generating procedure, the contour data outlined with the running stitch is deleted (S23). Then, for each similar color, the embroidery data is extracted (S24). That is, for the thick pink and thin pink, these are similar colors, and thus, the embroidery data regarding pink including the thick pink and thin pink is extracted.

Figure 14:
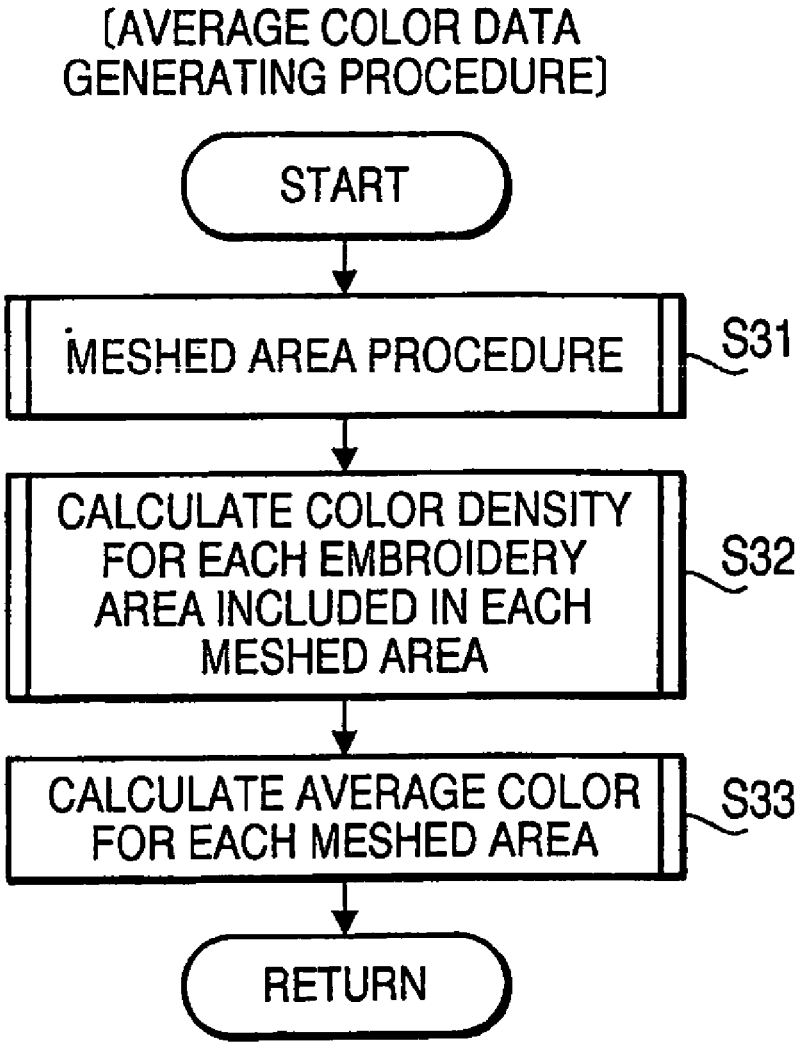
FIG. 14 shows a flowchart illustrating a procedure of an average color data creation for each mesh region according to aspects of the invention.
Figure 15:
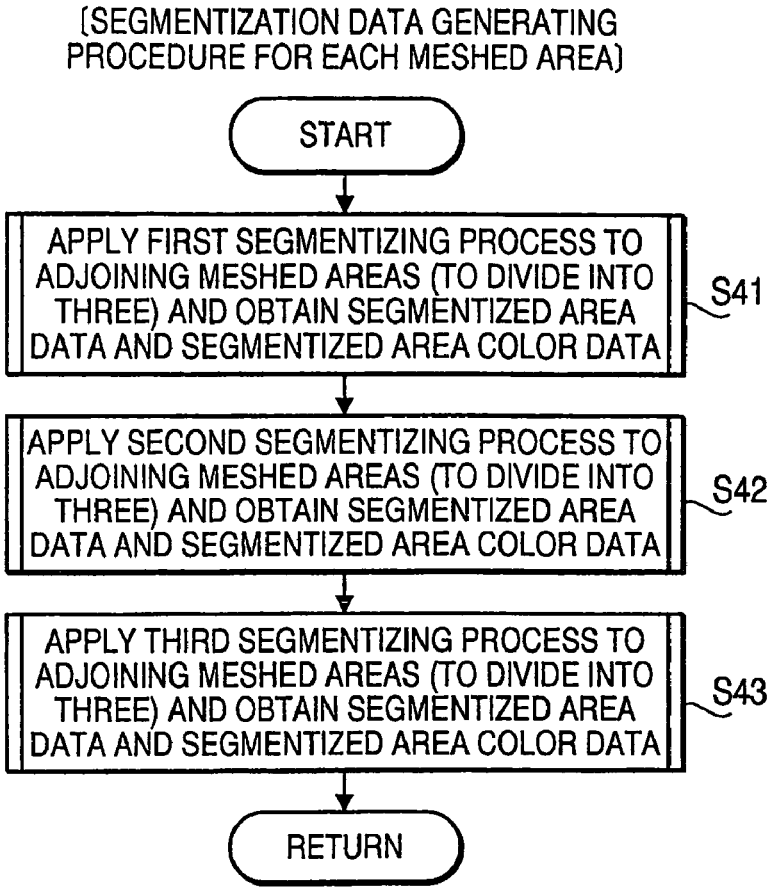
FIG. 15 shows a flowchart illustrating a procedure of a segmentized data creation for each mesh region according to aspects of the invention.

Next, an average color data generating procedure (FIG. 14) is executed (S25). In the average color data generating procedure, all the embroidery regions of the similar color are divided in accordance with mesh-divided areas, and in each meshed-divided area, the average color data is generated. Specifically, when this procedure is started, all the embroidery regions of the similar color are divided into small meshed areas (S31). Then, a color density value of each meshed area is determined (S32).

In S33, the color density value of each meshed area is averaged to determine an averaged color (S33). Then, the control finishes the procedure and returns to S26 of the second data processing procedure. In the second data processing procedure, for each similar color, a segmentized data generating procedure (S15) is executed to segmentized each meshed area so that the color changes gradually between the adjacent meshed areas (S26).

When the segmentized data generating procedure is started, a first segmentize procedure for dividing each of adjoining mesh area into three segments is executed. For each of the segmentized area, segmentized area data and color data for each of the segmentized area are calculated (S41). Then, for each of the segmentized areas, a second segmentize procedure for further dividing each of the segmentized area into three areas is executed (S41). Again, the segmentized area data and the area color data are calculated for each of the segmented area (S42).

Further, for each of the segmentized area, a third segmentize procedure is executed to divide each of the segmentized areas into three segmentized areas. The segmentized area data and the area color data are calculated for each of the segmented area (S43). Thereafter, the control returns to S27 of the second data processing procedure. In the second data processing procedure, based on the segmented area data and segmented area color data generated in S26, the print data for executing the printing operation on the embroidery area is generated (S27).

Next, based on the embroidery data read in S21, the embroidering operation using embroidery threads is executed (S28). In this operation, however, a thread of a thinner color is used for embroidering. Next, by the printing procedure instructed by the user, the printing operation is executed using the inkjet printer 3, based on the print data generated in S27, overlaid on the embroidery (S29).

The second data processing will be described in detail.

When the user selects "second gradation processing" using the pointer P from the "data processing menu" shown in FIG. 6, the embroidery data, which has been selected in advance, is retrieved, and region data defining embroidery regions (which are defined by stitch types such as tatami stitch, satin stitch, etc. and/or thread colors) are obtained, and contour data is deleted.

Figure 16:
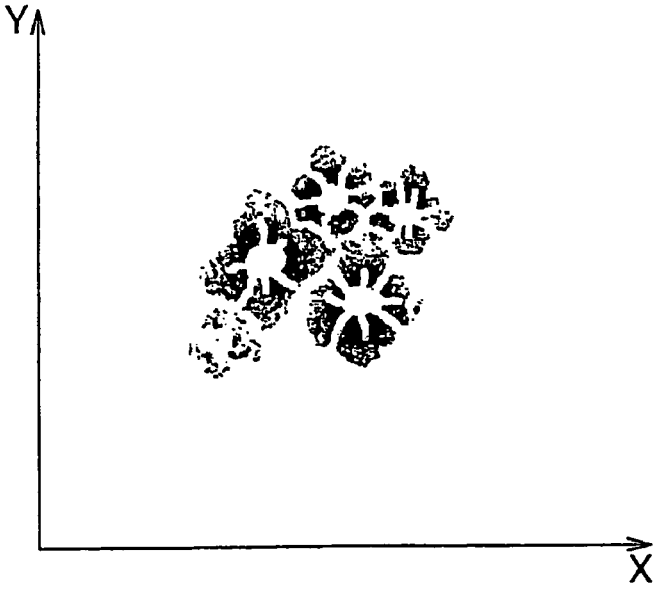
FIG. 16 shows the embroidery region of pink and similar color components of embroidery data.
Figure 17:
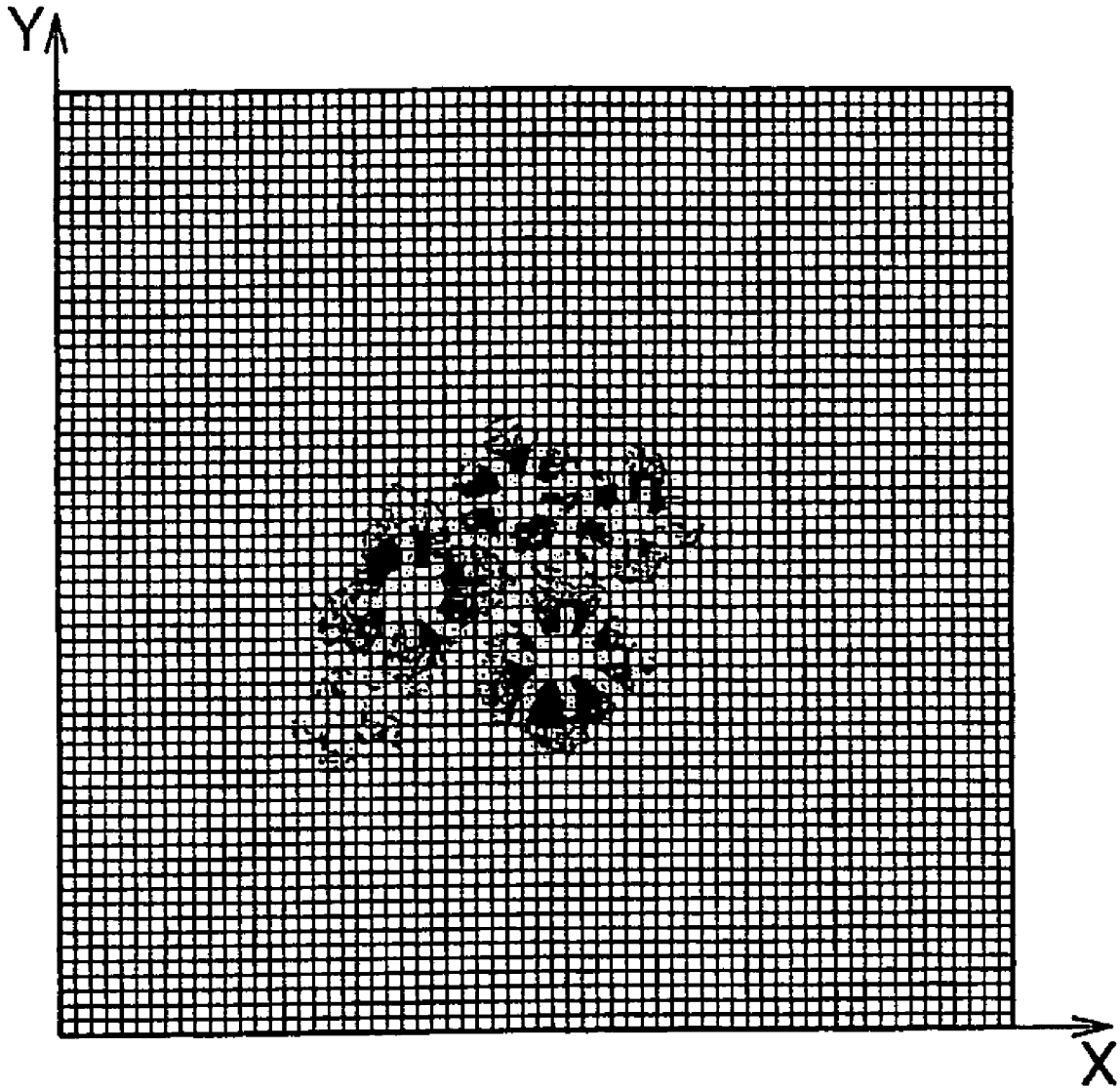
FIG. 17 shows a meshed region which is a mesh-divided representation of the embroidery region of pink and similar color components.

Thereafter, the embroidery data of the similar color, as shown in FIG. 16 for example, the embroidery data of pink color is extracted. Then, the pink embroidery area is divided into grid-like meshed areas having a size of 5 mm×5 mm, as shown in FIG. 17, and the average color data for each meshed area is calculated. This calculation will be described in detail using an example shown in FIG. 18, in which two meshed areas M35 and M36 are indicated. The meshed areas M35 and M36 include thick pink embroidery areas M35*a* and M36*a* and thin pink embroidery areas M35*b* and M36*b*.

In the ROM 22, an average density value table T1 (FIG. 19) and a segmentizing process table T2 (FIG. 20) are stored. In the average density value table T1, based on the thickness evaluation value representing the ratios (100%, 80%, 60%, 40%, 0%) of the thick color thread with respect to the meshed area, the average thickness values D (5, 4, 3, 2, 1) of the meshed area are indicated.

In the segmentizing process table T2, the average density values D are indicated in correspondence with the first segmentized data. The segrnentizing process table T2 also stores data representing correspondence between the second segmentized data and the third segmentized data. However, such data is similar to the data shown in FIG. 20 and is not indicated for the brevity.

Figure 18:
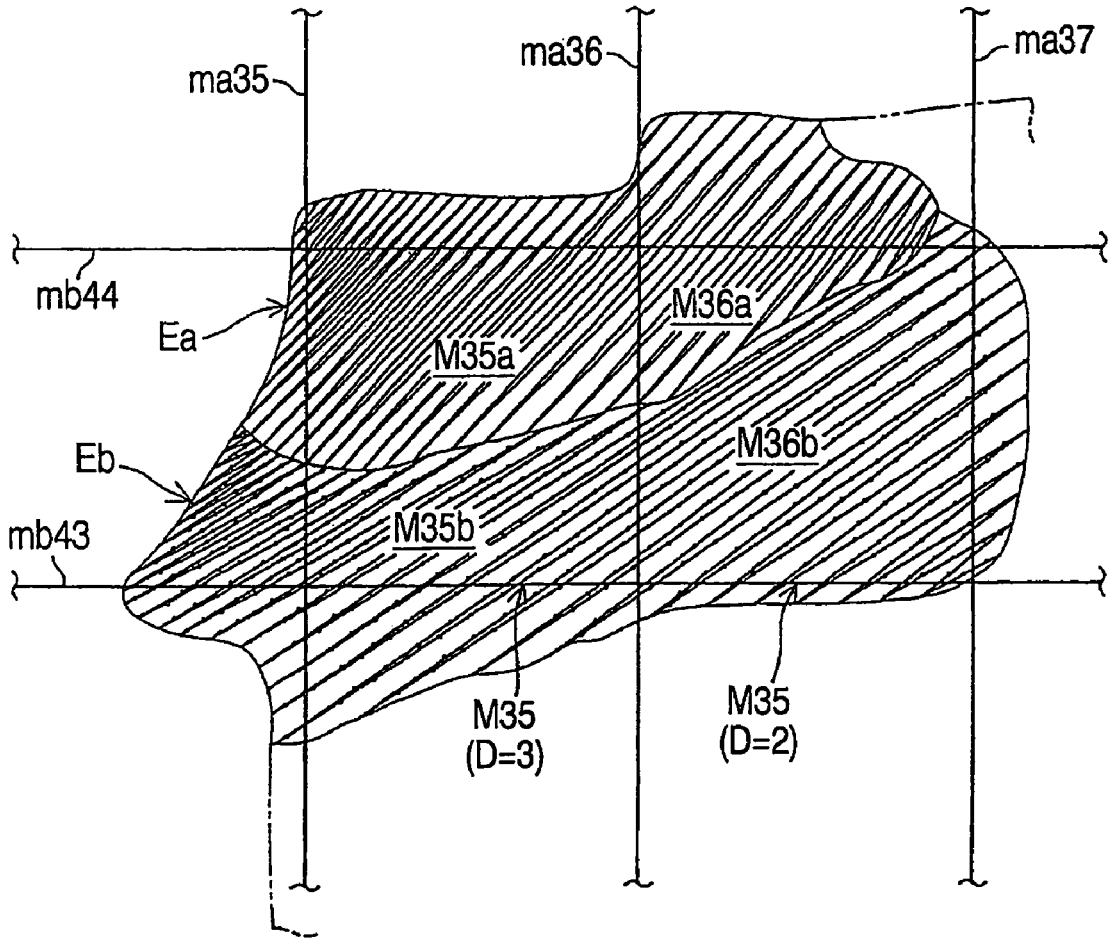
FIG. 18 shows an enlarged representation of a meshed region.

The average density value D of the meshed area M35 shown in FIG. 18 is set such that, the average density value D is set to "3" corresponding to the ratio "60%" which is a ratio the thick color thread occupies, and the average density value D of the meshed area M36 is set to "2" corresponding to the ratio "40%" which is a ratio the thick color thread occupies in this area.

When the first segmentization is carried out and the meshed area M35 is divided into three segments, the segmentized area color data at the leftmost segmentized area is "3.5", the segmentized area color data at the central segmentized area is "3.0", and the segmentized area color data at the rightmost segmentized area is "2.5".

Regarding the meshed area M36, the segmentized area color data at the leftmost segmentized area is "2.5", the segmentized area color data at the central segmentized area is "2.0", and the segmentized area color data at the rightmost segmentized area is "1.5".

For the meshed areas M35 and M36, the average color data generating process and the segmentize process are executed, which are similar processes and description thereof will be omitted for the brevity. Finally, based on the segmentized area data and segmentized area color data of each segmentized area, the print data corresponding to the embroidery areas Ea and Eb are generated.

Figure 12:
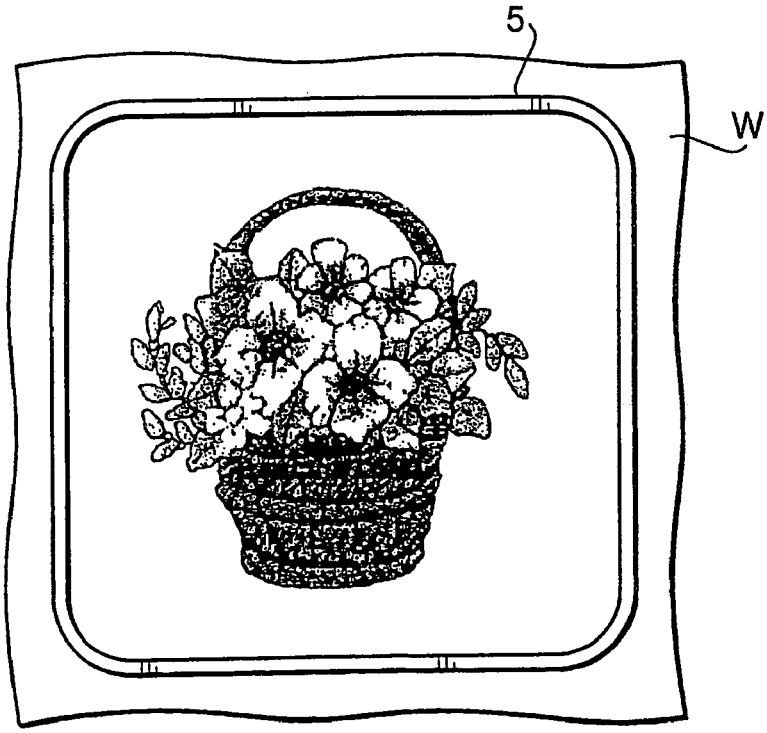
FIG. 12 shows an example of a pattern, "flower basket" formed (embroidered and printed) on fabric according to aspects of the invention.

Then, based on the retrieved embroidery data, the embroidering procedure is executed. It should be noted, however, the embroidering procedure is executed using a thinner color of the similar color. For example, as the similar color of the pink, a thinner pink thread is used for the embroidery. Then, based on the print data as generated, the printing procedure (FIG. 12) is executed.

As above, according to the illustrative embodiment, based on the embroidery data and the region data generated from the embroidery data, for each similar color component, the embroidery region is mesh-divided, and average color data of each meshed area is generated. Further, based on the segmentized area data which represents the segmentized meshed area and the segmentized area color data, the print data is generated. Therefore, after the embroidering based on the embroidery data, the printing process is executed based on the print data which has been compensated to the average color, in the embroidery region of the similar color, the color can be changed gradually like the gradation effect, which improves the appearance and texture.

It should be noted that the above-described segmentization process is only an illustrative example, and can be modified in various ways. For example, in the segmentization process table T2 shown in FIG. 20, the segmentized areas have the same widths. However, it is also possible to vary the widths of the segmentized areas (e.g., the central segmentized area may have a half of the entire width, and each of the right and left segmentized areas may have ¼ of the entire width).

The values of the segmentized area color data of the segmentization process table T2 are also changeable. Further, the meshed area can be divided into two, four or more instead of three as in the illustrative embodiment.

Figure 21:
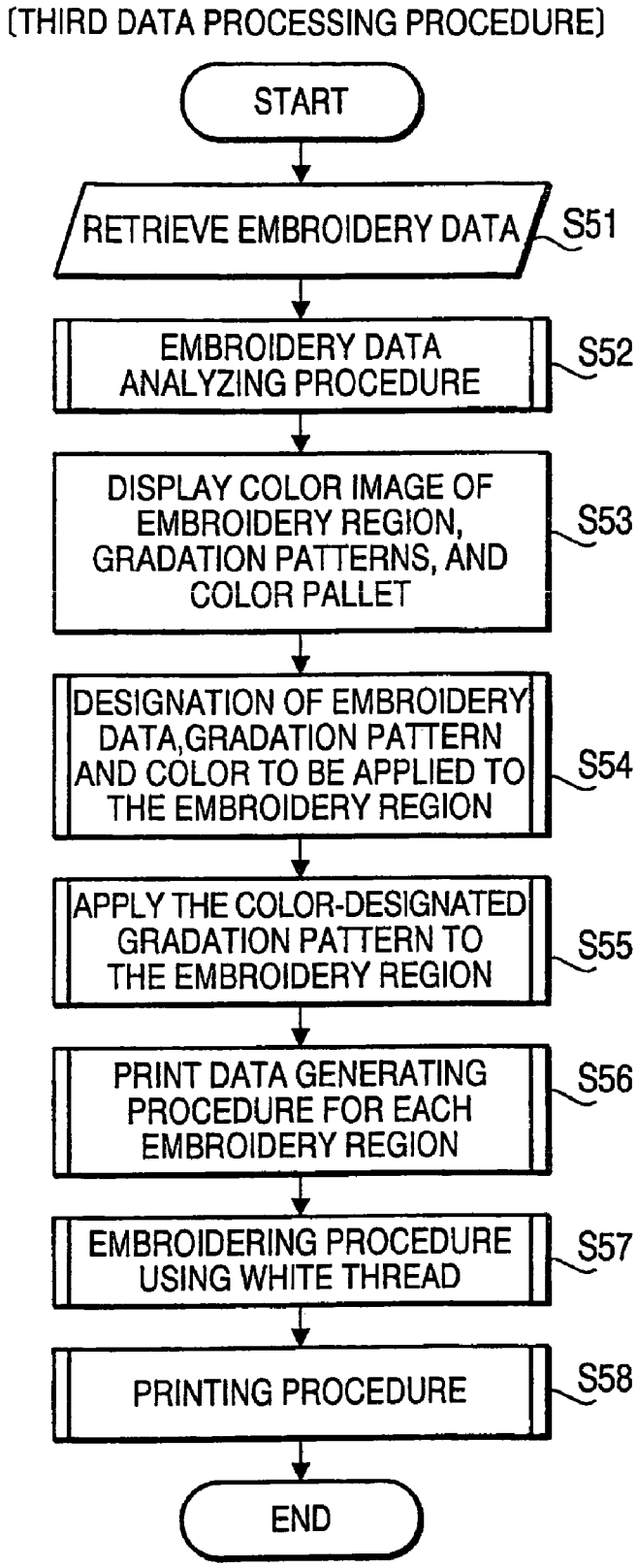
FIG. 21 is a flowchart illustrating a procedure of a third data processing.

If the user selects the "third gradation process" with the pointer P in the "data processing menu" shown in FIG. 6, the third data processing procedure shown in FIG. 21 is started. When this procedure is started, the embroidery data which has been selected in advance among a plurality of pieces of the embroidery data stored in the CD-ROM or RAM 23 is retrieved (S51). Next, in order to define a plurality of embroidery regions, the embroidery data is analyzed (S52). Since the region data generating procedure has been described, the description thereof will be omitted for the brevity.

Next, on the display 14, color representation of a plurality of embroidery areas, a plurality of gradation patterns and the color pallets thereof are displayed (S53). The plurality of gradation patterns, in this example, are stored in the ROM 23 in advance. Then, the designation procedure is executed and the user is allowed to designate a gradation pattern, an embroidery region to which the gradation pattern is applied, and the color of the gradation by moving the pointer (S54).

Next, a applying procedure to apply the designated gradation pattern to the designated embroidery region with the designated color (S55). Next, for the entire region of the embroidery region, colorful print data with the colored gradation pattern is generated for each embroidery region (S56). Next, based on the embroidery data retrieved in S51, the embroidering procedure using the embroidery thread is executed (S57). It should be noted that, according to the illustrative embodiment, the embroidery is executed using a white thread.

Next, the printing procedure instructed by the user is execute and on the embroidery formed with the white thread, the printing operation is executed in accordance with the print data which has generated in S56 by the inkjet printer 3 (S58).

Next, the third data processing will be described in detail.

When the user selects the "third gradation process" using the pointer P from the "data processing menu" shown in FIG. 6, the embroidery data of the embroidery pattern of "flower basket" which has been selected in advance, and the region data of the embroidery region defined by the stitch type such as the tatami stitch and sating stitch, and the color of the threads is obtained.

Figure 22:
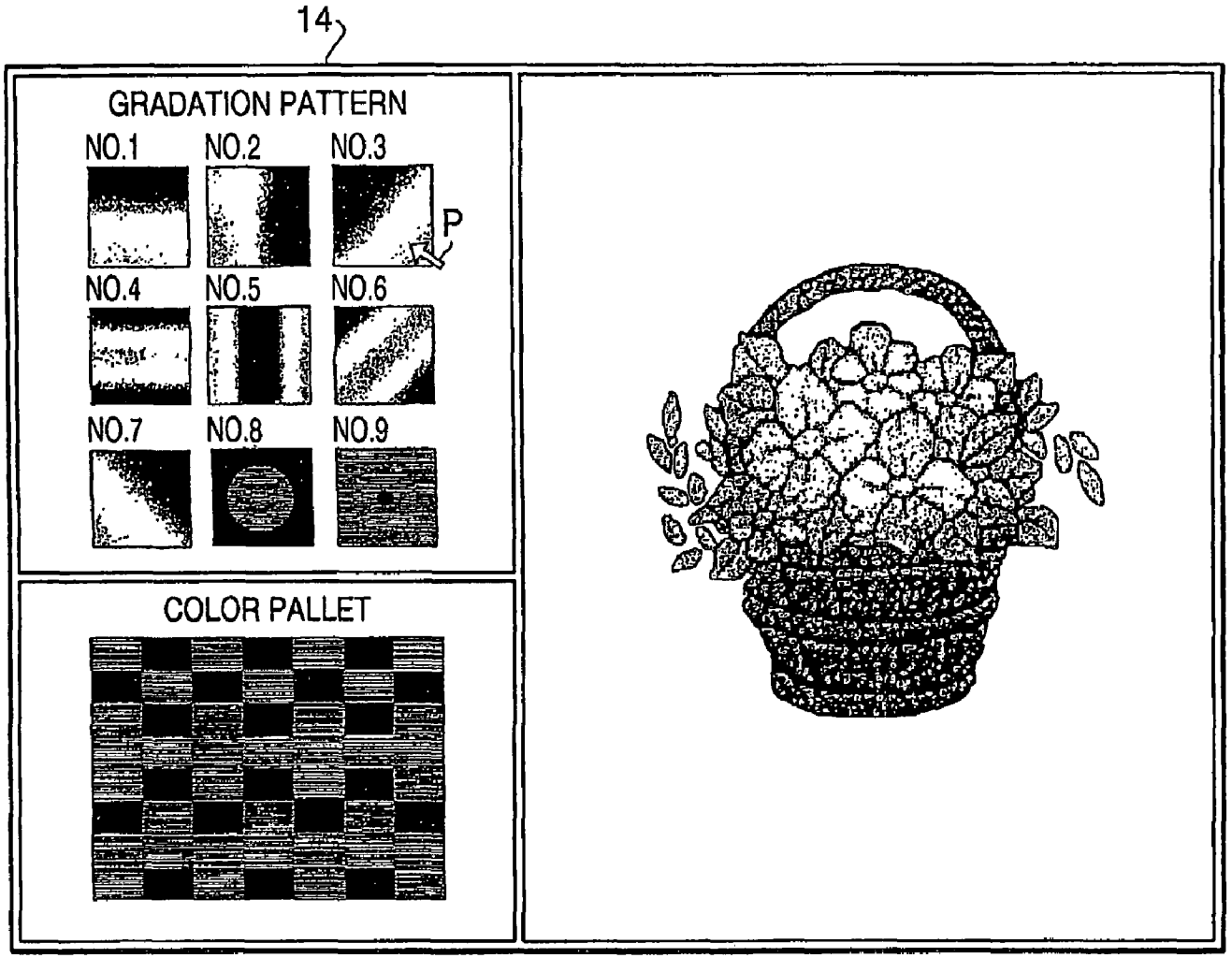
FIG. 22 shows an example of onscreen representation of an embroidery region, gradation pattern and color pallet.

Then, as shown in FIG. 22 for example, a color representation of the embroidery region for the embroidery pattern "flower basket" is displayed on the display 14. On the left-hand side thereof, nine types (No. 1-No. 9) of the gradation patterns are displayed, and below the gradation patterns, a color pallet of a plurality of colors. It should be noted that, in ROM 22, the nine types of gradation patterns are stored in advance.

According to the illustrative embodiment, each of the gradation patterns (No. 1-No. 9) is defined by a monochromatic gradation pattern and color designation data. The user, thus, moves the pointer P to designate the embroidery region to which the gradation pattern is to be applied, and the gradation pattern to be applied to the embroidery region and the color applied to the designated gradation pattern.

As a result, using the designated color, the designated gradation pattern (e.g., No. 4) is applied to the entire region of the designated embroidery region (e.g., the embroidery region of the flower and the embroidery region of the basket) and the print data is generated. It should be noted that, in order to apply the gradation pattern to the entire embroidery region, a magnifying (or a reducing) process is applied so that the gradation pattern can be applied to the entire embroidery region.

Figure 23:
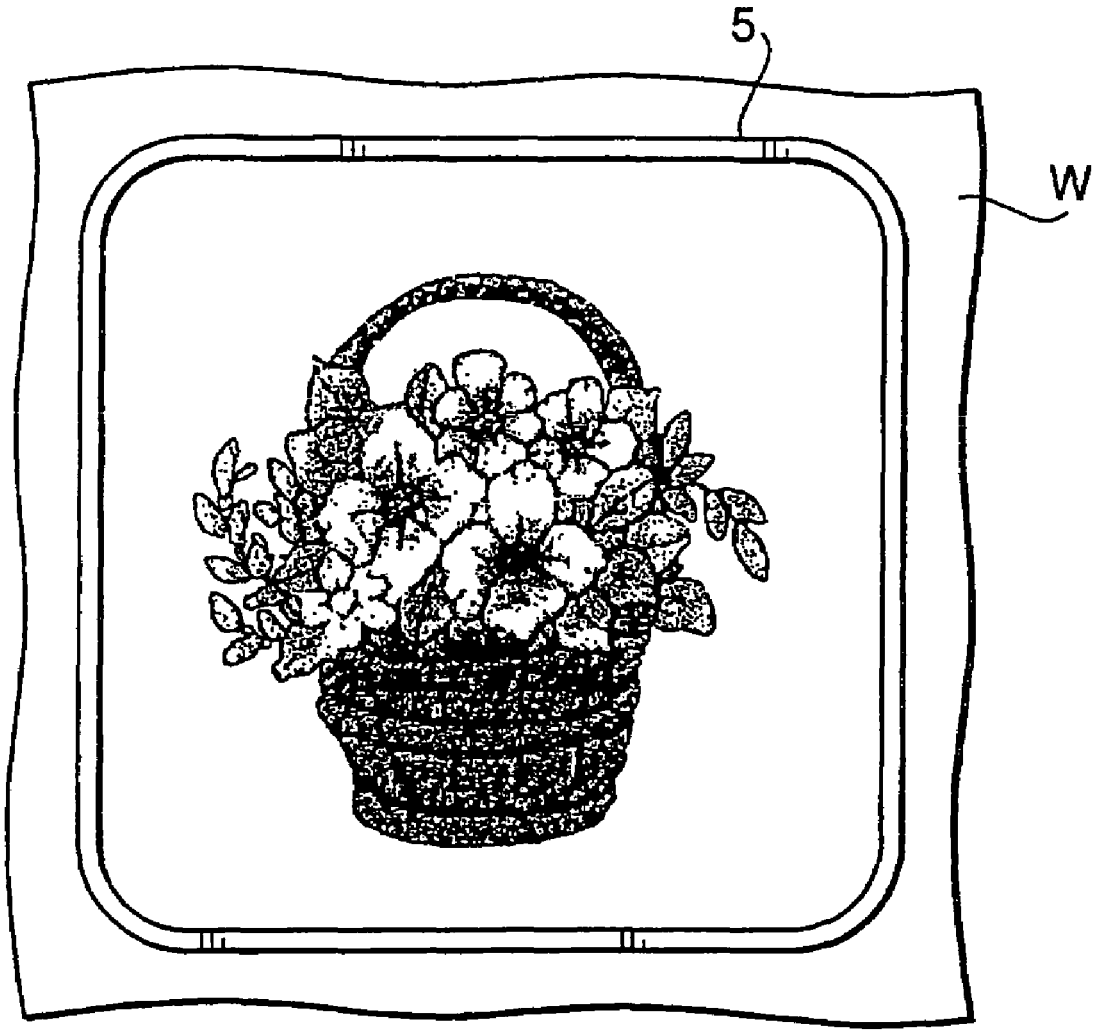
FIG. 23 shows the "flower basket" formed (embroidered and printed) on the fabric.

For example, if gradation pattern No. 4, "brown" and "pink", and entire "flower basket" are designated, the embroidery is formed with the white thread based on the embroidery data on the fabric W set onto the embroidery frame 5, and thereafter, the color printing is performed based on the print data. Then, as shown in FIG. 23, the gradation printing is performed on the lower part of the basket and the upper part (a handle part) of the basket with the designated color of "brown", while the gradation printing is performed on the flower portion with the designated color of "pink".

As described above, according to the illustrative embodiment, the user can designate any one of the embroidery regions which are defined based on the embroidery data, and further, a desired gradation pattern, the print data representing the gradation pattern applied to the designated embroidery region can be created. By executing the printing of the gradation pattern after the embroidery is formed, the pattern can be printed on the embroidery such that the color of the embroidery gradually changes, which improves the appearance and texture of the embroidery pattern.

In the third data processing described above, after the embroidery is formed using the embroidering machine 2, the gradation pattern is employed as the printed pattern overlaid on the embroidery pattern. The invention, however, need not be limited to this illustrative configuration, but various types of pattern may be overlaid on the embroidery pattern. In such a case, a plurality of print patterns to be overlaid on the embroidery pattern may be stored in the ROM 22, and the user may be allowed to designate a desired one of the stored patterns, and the print data for overlaying the designated pattern on the embroidery region can be created.

With the above configuration, it becomes possible to form the embroidery using a single white thread with the embroidering machine 2, and then print a desired pattern overlaid on the embroidery. Therefore, a variety of embroidery patterns can be formed.

In S26 of the second data processing shown in FIG. 13, the number of execution of the segmentizing procedure is need not be limited to three times, and can be more than three times. Further, in one segmentizing procedure, the region may be divided into more than three segmentized areas.

In the above-described illustrative embodiment, the data processing device 1 is provided separately from the embroidering machine 2. This configuration may be modified such that the control unit 42 of the embroidering machine 2 may also function as the data processing device 1. If such a configuration is employed, without preparing the data processing device 1 typically comprised of a personal computer, the embroidering machine 2 can be used effectively.

It should be noted that the invention need not be limited to the above-described illustrative embodiment, but can be modified in various ways in accordance with aspects of the invention.

What is claimed is:

1. A data processing device configured to process embroidery data for a sewing machine capable of embroidering and print data for a printer, the printer printing a pattern on at least a portion of an embroidery formed by the sewing machine, the data processing device comprising:

an embroidery data generating unit configured to generate region data defining a plurality of embroidery regions based on color image data and the embroidery data defining embroidery patterns to be formed on the plurality of embroidery regions, respectively;

a color designating unit configured to designate a thread color from a plurality of thread colors contained in the embroidery data in order to designate a print-target embroidery region from among the plurality of embroidery regions; and a print data generating unit that generates print data representing an image formed on the print-target embroidery region based on at least part of image data corresponding to the print-target embroidery region designated by the color designating unit, wherein the print data generating unit includes a color compensation unit that compensates for the print data such that the thickness density of a color of the pattern printed based on the print data on the print-target embroidery region is reduced corresponding to the color of the thread forming the embroidery at the embroidery region.

2. A data processing device configured to process embroidery data for a sewing machine capable of embroidering and print data for a printer, the printer printing a pattern on at least a portion of an embroidery formed by the sewing machine, the data processing device comprising:

a region data generating unit configured to generate region data defining a plurality of embroidery regions having different thread colors based on the embroidery data;

an average color data generating unit configured to divide the embroidery region of a similar color into a plurality of meshes in accordance with the embroidery data and the region data, and create average color data representing average of the thread colors of each mesh area;

a segmentized data generating unit configured to generate segmentized area data and segmentized area color data by segmentizing each mesh area so that the color gradually changes between two adjacent mesh areas of the similar color in accordance with the region data and the average color data; and a print data generating unit that generates print data representing a print pattern to be applied to the embroidery region based on the segmentized area data and segmentized area color data generated by the segmentized data generating unit.

3. The data processing device according to claim 2 wherein the similar color includes a thick color and a thin color.

4. A data processing device configured to process embroidery data for a sewing machine capable of embroidering and print data for a printer, the printer printing a pattern on at least a portion of an embroidery formed by the sewing machine, the data processing device comprising:

a region data generating unit configured to generate region data defining a plurality of embroidery regions based on the embroidery data;

a pattern storage unit configured to store a plurality of image patterns to be applied to the plurality of embroidery regions;

a pattern designating unit configured to designate a desired image pattern from among the plurality of image patterns stored in the pattern storage unit;

a region designating unit configured to designate a desired embroidery region among the plurality of embroidery regions; and a print data generating unit configured to generate print data which applies the image pattern designated by the pattern designating unit to the embroidery region designated by the region designating unit in accordance with the region data of the plurality of embroidery regions defined by the region data generating unit, wherein the pattern storage unit stores a plurality of predetermined gradation patterns, and wherein the print data generating unit generates the print data which applies the gradation pattern designated by the pattern designating unit to the embroidery region designated by the region designating unit.

5. The data processing device according to claim 4, wherein each of the plurality of predetermined gradation patterns stored in the pattern storage unit is defined by monochromatic gradation pattern data and color designating data.

6. The data processing device according to claim 4, wherein the desired image pattern is designated with respect to each color of the print data.

7. The data processing device according to claim 4, wherein the image pattern includes a gradation pattern, and wherein the print data generating unit generates print data containing the gradation pattern to which a magnifying/reducing process is applied so that the gradation pattern can be applied to the entire desired embroidery region.

8. A computer-readable recording medium that stores a computer executable computer program comprising computer readable instructions that causes a computer to execute instructions for processing embroidery data for a sewing machine capable of embroidering and print data for a printer, the printer printing a pattern on at least a portion of an embroidery formed by the sewing machine, the program comprising:

instructions for generating region data defining a plurality of embroidery regions based on color image data and the embroidery data defining embroidery patterns to be formed on the plurality of embroidery regions, respectively;

instructions for designating a thread color from a plurality of thread colors contained in the embroidery data in order to designate a print-target embroidery region from among the plurality of embroidery regions; and instructions for generating print data representing an image formed on the print-target embroidery region based on at least part of image data corresponding to the print-target embroidery region designated in the instructions for designating the thread color, wherein the instructions for generating print data includes compensating for the print data such that the thickness density of a color of the pattern printed based on the print data on the print-target embroidery region is reduced corresponding to the color of the thread forming the embroidery at the embroidery region.

9. A computer-readable recording medium that stores a computer executable computer program for processing embroidery data for a sewing machine capable of embroidering and print data for a printer, the printer printing a pattern on at least a portion of an embroidery formed by the sewing machine, the program comprising:

instructions for generating region data defining a plurality of embroidery regions having different thread colors based on the embroidery data;

instructions for dividing the embroidery region of a similar color into a plurality of meshes in accordance with the embroidery data and the region data, and creating average color data representing average of the thread colors of each mesh area;

instructions for generating segmentized area data and segmentized area color data by segmentizing each mesh area so that the color gradually changes between two adjacent mesh areas of the similar color in accordance with the region data and the average color data; and instructions for generating print data representing a print pattern to be applied to the embroidery region based on the segmentized area data and segmentized area color data.

10. The computer program according to claim 9 wherein the similar color includes a thick color and a thin color.

11. A computer-readable recording medium that stores a computer executable computer program for processing embroidery data for a sewing machine capable of embroidering and print data for a printer, the printer printing a pattern on at least a portion of an embroidery formed by the sewing machine, the program comprising:

instructions for storing a plurality of image patterns in a pattern storage unit to be printed;

instructions for generating region data defining a plurality of embroidery regions based on the embroidery data;

instructions for first designating a desired image pattern to be applied to a desired embroidery region from among the plurality of image patterns stored in the pattern storage unit;

instructions for second designating a desired embroidery region among the plurality of embroidery regions; and instructions for generating print data which applies the image pattern designated in the first designating to the embroidery region designated in the second designating in accordance with the region data of the plurality of embroidery regions defined in the generating region data, wherein the pattern storage unit stores a plurality of predetermined gradation patterns, and wherein the instructions for generating print data generate the print data that applies the gradation pattern designated by the pattern designating unit to the embroidery region designated by the instructions for second designating.

12. The computer program according to claim 11, wherein each of the plurality of predetermined gradation patterns stored in the pattern storage unit is defined by monochromatic gradation pattern data and color designating data.

13. The data processing device according to claim 11, wherein the desired image pattern is designated with respect to each color of the print data.

14. The computer-readable recording medium according to claim 11, wherein the image pattern includes a gradation pattern, and wherein the print data is generated by applying a magnifying/reducing process to the gradation pattern so that the gradation pattern can be applied to the entire desired embroidery region.

* * * * *